United States Patent [19]

Dodd

[11] 4,168,938

[45] Sep. 25, 1979

[54] BLADE OR VANE FOR A GAS TURBINE ENGINE

[75] Inventor: Alec G. Dodd, Belper, England

[73] Assignee: Rolls-Royce Limited, London, England

[21] Appl. No.: 763,707

[22] Filed: Jan. 28, 1977

[30] Foreign Application Priority Data

Jan. 29, 1976 [GB] United Kingdom ..... 3464/76

[51] Int. Cl.[2] ..... F01D 5/18

[52] U.S. Cl. ..... 416/97 R; 415/115

[58] Field of Search ..... 415/115; 416/96 R, 96 A, 416/97 R, 97 A; 60/39.66

[56] References Cited

U.S. PATENT DOCUMENTS

| | | | |
|---|---|---|---|
| 3,533,711 | 10/1970 | Kercher | 416/96 |
| 3,540,811 | 11/1970 | Davis | 416/97 R |
| 3,635,586 | 1/1972 | Kent et al. | 415/115 |
| 3,891,348 | 6/1975 | Auxier | 416/97 |
| 3,930,748 | 1/1976 | Redman et al. | 415/115 |
| 4,021,139 | 5/1977 | Franklin | 416/97 R |
| 4,025,226 | 5/1977 | Hovan | 416/97 A |

*Primary Examiner*—Stephen C. Bentley

*Attorney, Agent, or Firm*—Cushman, Darby & Cushman

[57] ABSTRACT

A hollow blade or vane for a gas turbine engine is provided with a longitudinally extending, hollow thickened portion in its wall adjacent the leading edge. This hollow thickened portion acts as an integral strut and relieves the leading edge of some loads.

9 Claims, 3 Drawing Figures

FIG. 1.
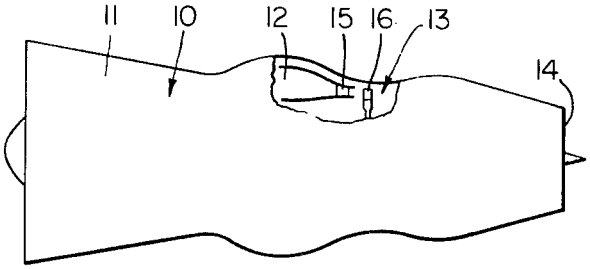
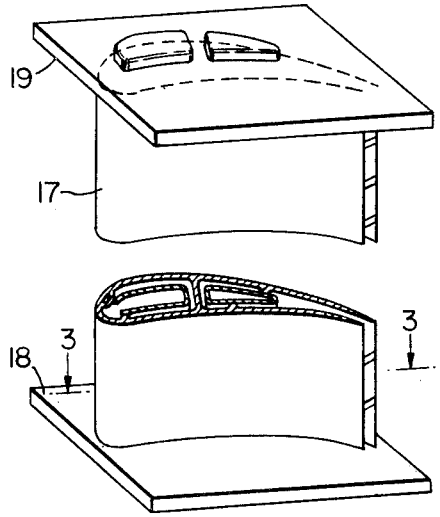
FIG. 2.
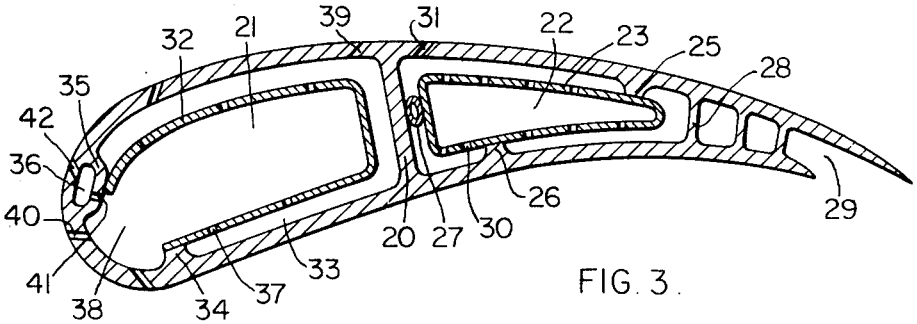
FIG. 3.

BLADE OR VANE FOR A GAS TURBINE ENGINE

This invention relates to a vane or blade for a gas turbine engine.

Such blades or vanes are often made with an aerofoil section which comprises a relatively thin-walled hollow structure; this is most often the case where the blade or vane needs to be provided with cooling by means of a cooling fluid fed to the inside of the hollow aerofoil. In such a blade or vane there is considerable stress put on the leading edge of the aerofoil, since the cooling fluid is normally at a greater pressure than the maximum obtaining outside the aerofoil, and is therefore at a much greater pressure than that obtaining outside the convex or suction flank of the aerofoil. This means that there is a large resultant force on this flank of the aerofoil tending to force it away from the opposite flank and consequently putting a large bending stress on the leading edge area.

In many cases it is desirable to provide the leading edge with a plurality of holes to allow film cooling; clearly this weakens the leading edge region and exacerbates the problem.

The present invention provides a convenient way in which the leading edge area may be relieved of some of these loads.

According to the present invention a hollow blade or vane for a gas turbine engine comprises a hollow aerofoil section whose wall is provided with a longitudinally extending thickened portion adjacent the leading edge, said thickened portion itself being hollow so that it forms an integral hollow strut in the wall.

Said hollow strut may extend to and be connected with at least an inner or an outer platform of the blade or vane.

Preferably the hollow strut is provided with cooling air entry holes through which air may flow into its hollow interior, and it may also have cooling air exit holes adapted to allow cooling air to flow out to the blade surface to provide film cooling.

Said thickened portion may serve as a location feature for a cooling air entry tube which extends longitudinally within the blade, and said cooling air entry holes may then communicate with the interior of said tube so as to allow the supply of said cooling air.

The invention will now be particularly described, merely by way of example, with reference to the accompanying drawings in which:

FIG. 1 is a partly broken-away view of a gas turbine engine having vanes in accordance with the invention, FIG. 2 is an enlarged perspective view of one of the vanes of FIG. 1, partly broken away to show the interior construction, and FIG. 3 is a further enlarged section on the line 3—3 of FIG. 2.

In FIG. 1 there is shown a gas turbine engine which comprises a casing 10 within which are disposed in flow series a compressor section 11, combustion section 12, turbine 13 and final exhaust 14. The engine operates in the conventional manner in that air is compressed in the compressor 11, burnt with fuel in the combustion section 12, the hot gases resulting drive the turbine 13 which in turn drives the compressor 11, and the hot gases from the turbine then exhaust through the nozzle 14 to provide propulsive thrust.

Because the temperature reached in the combustion section 12 is very high, it is necessary to cool various of the parts in and adjacent to the combustion section, in particular the nozzle guide vanes 15 which direct hot gases onto the turbine rotor, and the turbine rotor blades 16 which receive these hot gases.

In the embodiment described it is the vanes 15 which include the construction in accordance with the invention, however, it should be appreciated that this construction is equally applicable to the rotor blades 16. In FIG. 2 one of the vanes 15 is shown enlarged and with its centre section cut-away so as to expose the interior of the vane. It will be seen that the vane comprises an aerofoil section 17 and inner and outer platform members 18 and 19, these platform members cooperating with similar members on adjacent vanes to form the inner and outer boundaries of the annular flow path of hot gases from the combustion chamber 12. Because of the high temperature of the gases impinging on the aerofoil section 17 it is necessary to provide some cooling for this section and therefore as can be seen in FIGS. 2 and 3 this portion of the vane is made hollow. In fact the aerofoil is made as a thin walled hollow casting having a central rib 20 which extends between its concave and convex flanks to assist in retaining these together. The rib 20 divides the hollow interior into a forward compartment 21 and a rearward compartment 22. Within the rearward compartment 22 there is supported a rearward cooling air entry tube 23 which is retained in position by longitudinal ribs 25 and 26 and a longitudinally extending deformable sealing member 27. The rearward portion of the section 22 is provided with pedestals 28 which extend from one flank to the other of the blade and which retain these flank portions together. At its rearmost extremity the portion 22 runs into a longitudinally extending trailing edge slot 29.

In order to allow cooling air to be fed into the rearward section of the blade the tube 23 extends through the platform 19 and is there in communication with a source of cooling air (not shown). The tube 23 is provided with a number of apertures as for instance at 30 which provide impingement cooling of the interior of the rearward section, while rows of film cooling holes 31 allow film cooling of certain regions of the exterior surface. The remaining cooling air flows between the pedestals 28 and out through the trailing edge slot 29.

In a similar fashion the forward section 21 of the vane is provided with an air entry tube 32 which also extends through the platform 19 to communicate with a source of cooling air. The tube 32 is retained in place in the section 21 by a plurality of chordwise extending ribs 33 and by a longitudinal rib 34 and a thickened portion 35 of the wall of the aerofoil. The thickened portion 35 extends from the platform 18 to the platform 19 and is joined thereto; in fact it is formed as an integral part of the single casting which forms the aerofoil and the platforms. The thickened portion 35 is also provided with a central hollow 36 which again extends the full length of the thickened portion so that this portion becomes in effect, a tube extending from one platform to the other.

The cooling system of the forward section differs from that of the rearward section although some features are common. Air which enters the cooling air tube 32 flows out from the tube through a plurality of impingement cooling apertures such as are indicated at 37 and through the cut away forward portion of the tube at 38. Air which passes through the impingement apertures 37 impinges on the interior of the aerofoil and then flows to one of a number of rows of film cooling holes 39 which allow the air to escape to the external surface of the aerofoil in the form of a film of air. Air which passes through the cut away portion 38 can escape from the blade in one of two ways; it either passes directly through one of the rows of leading edge film cooling holes 40 to the surface of the blade or else it flows through a further longitudinally extending row of impingement holes 41 and impinges on a portion of the hollow interior 36 of the thickened portion 35. From there it escapes to the surface of the vane through a further row of film cooling holes 42.

It will be appreciated that because the cooling air must be of sufficient pressure to escape from the blade through the film cooling holes, its pressure must be greater than the maximum pressure of the gases surrounding the vane. It will therefore be of substantially greater pressure than the relatively low pressure outside the convex or suction flank of the vane and there is therefore a considerable force on this flank tending to pull it away from the pressure flank. This will put a bending stress on the leading edge, which is already weakened by the provision of rows of film cooling holes such as 40. The thickened portion 35, forming as it does a hollow tube anchored at both ends to the platforms of the vane provides a kind of torsion girder which takes these loads on the suction surface into the platforms without transmitting the major proportion onto the leading edge.

Additionally the provision of this hollow enables the pressure of the impingement air through the holes 41 to be accurately adjusted to that necessary to provide film cooling through the holes 42; this is otherwise a matter of difficulty in the leading edge area where the pressures outside the vane vary rapidly with position. It will also be noted that this technique provides one of the three mounting features necessary to provide accurate location of the tube 32 within the forward region 21, the others being the rib 34 and the ribs 33; these mounting features together with the hollow 36 allow three different pressures of film cooling to be exhausted to the surface of the blade.

As intimated above we propose that the thickened area 35 and its internal hollow should be made when the vane is produced as a casting; thus the hollow 36 may be formed by a core which may be a rod of silica which displaces metal through the casting process and is subsequently leached out to leave a cavity. Otherwise the hole 36 may be produced by a drilling process.

It will be appreciated that it would be possible to modify the embodiment described above. Thus the position of the thickened portion is not critical and it could be used to relieve the leading edge of stresses from the concave flank of the blade, or alternatively two said thickened portions may be used to relieve the leading edge of both sets of stresses. Additionally it will be appreciated that the thickened portion in accordance with the invention is useful regardless of the cooling system and internal configuration of the remainder of the aerofoil section and platforms.

I claim:

1. A hollow blade or vane for a gas turbine engine comprising a thin-walled hollow aerofoil section of generally uniform wall thickness and devoid of flank-connecting ribs adjacent the leading edge, the wall of said aerofoil section being provided with a longitudinally extending thickened portion adjacent said leading edge, the transverse dimensions of said portion being less than the thickness of said section, said thickened portion itself being hollow so that it forms an integral hollow strut in said wall to resist bending stresses in said wall adjacent said leading edge.

2. A hollow blade or vane as claimed in claim 1 and in which said hollow blade or vane comprises a platform on at least one extremity of the aerofoil, the hollow strut extending to and being connected with said platform to take the bending stresses thereto.

3. A hollow blade or vane as claimed in claim 2 and in which said hollow strut is provided with cooling air entry holes through which cooling air may flow into its hollow interior from the interior of the section.

4. A hollow blade or vane as claimed in claim 3 and in which said hollow strut is provided with cooling air exit holes adapted to allow cooling air to flow out from its hollow interior to the surface of the blade or vane to provide film cooling of the surface.

5. A hollow blade or vane as claimed in claim 1 and comprising a cooling air entry tube extending longitudinally within the hollow interior of the blade or vane and abutting against said hollow strut which acts as a location feature for the tube.

6. A hollow blade or vane as claimed in claim 5 and in which the hollow strut is provided with cooling air entry holes which communicate with the interior of the air entry tube so that cooling air may flow from the cooling air entry tube into the hollow strut.

7. A hollow blade or vane as claimed in claim 5 and in which said air entry tube comprises a plurality of apertures therein through which cooling air may flow from its interior to impingement cool the interior of the blade or vane.

8. A hollow blade or vane as claimed in claim 1 and in which the leading edge region of the blade or vane wall has holes through it through which cooling air may flow from the hollow interior of the strut to the exterior surface of the leading edge to film cool this surface.

9. A hollow blade or vane as claimed in claim 1 and comprising a transverse, longitudinally extending web which divides the hollow interior of the vane into a forward and a rearward portion.

* * * * *